United States Patent [19]

Tabak

[11] Patent Number: 4,594,143

[45] Date of Patent: Jun. 10, 1986

[54] PROCESS FOR REACTING LIGHT OLEFINS AND JET FUEL

[75] Inventor: Samuel A. Tabak, Wenonah, N.J.

[73] Assignee: Mobil Oil Corporation, New York, N.Y.

[21] Appl. No.: 410,287

[22] Filed: Aug. 23, 1982

[51] Int. Cl.[4] ..... C10G 1/00

[52] U.S. Cl. ..... 208/46; 585/467

[58] Field of Search ..... 208/46; 585/467

[56] References Cited

U.S. PATENT DOCUMENTS 3,716,596 2/1973 Bowes ..... 585/467

4,241,036 12/1980 Flanigen et al. ..... 585/467

*Primary Examiner*—Curtis R. Davis

*Attorney, Agent, or Firm*—Alexander J. McKillop; Michael G. Gilman

[57] ABSTRACT

Light olefins are co-processed with aromatic-containing jet fuel range distillate over a large pore zeolite to produce an olefinic distillate and a high molecular weight alkyl aromatic fraction higher boiling than the olefinic distillate. The alkyl aromatic fraction is of high cetane value and can be separated from the olefinic distillate and used as blending material for diesel fuel.

10 Claims, 1 Drawing Figure

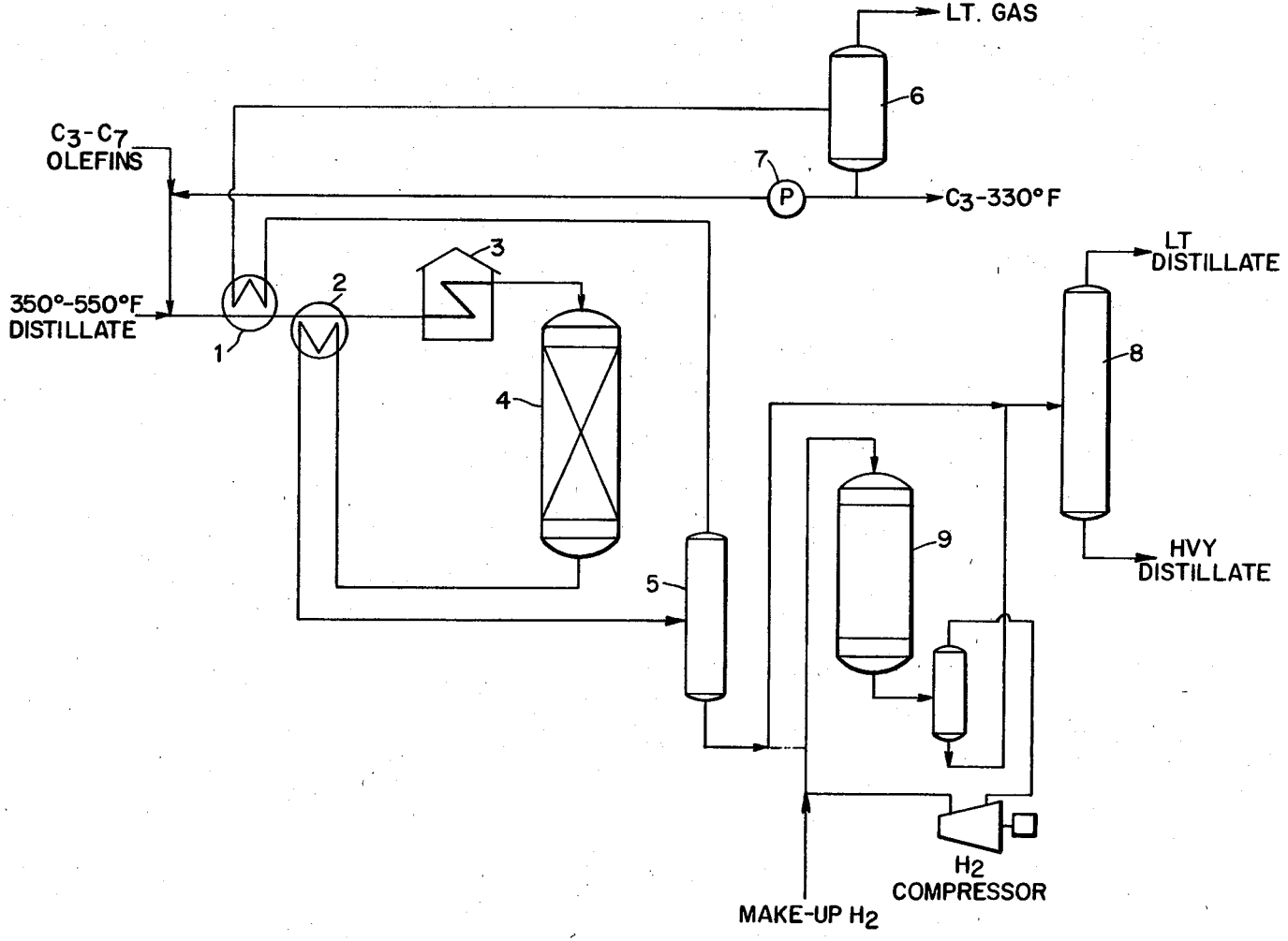
LT. GAS
6
C3-330°F
7
P
LT DISTILLATE
8
HVY DISTILLATE
9
H2 COMPRESSOR
MAKE-UP H2
5
4
3
2
1
C3-C7 OLEFINS
350°-550°F DISTILLATE

PROCESS FOR REACTING LIGHT OLEFINS AND JET FUEL

BACKGROUND OF THE INVENTION

1. Field of the Invention

This invention relates to the production of a jet fuel range olefinic distillate and, more specifically, to the co-processing of light olefins with jet fuel range distillate over a large pore zeolite to result in the formation of a substantially aromatic-free jet fuel range distillate and a high molecular weight alkyl aromatic fraction.

Jet fuels are petroleum stocks that boil in the range of about 350° F. to about 700° F. with the major portion boiling below about 500° F. The performance of jet fuels depends on the cleanliness of combustion which is measured by the smoke point of the fuel and, of course, will depend on the heat value of the fuel. One limit to jet fuel quality is the aromatic content. Aromatic carbons increase smoke emissions and generally decrease the heat value of the jet fuel.

At present, removal of aromatics from jet fuel quality distillate is accomplished by solvent extraction to strip the aromatics or by severe hydrotreating of the distillate to saturate the aromatic carbons. Various solvents are presently employed in solvent extracting the aromatics from petroleum distillates. Furfural is one example of a versatile solvent used for extracting aromatics from all petroleum stocks higher-boiling than gaoline. Hydrotreating to saturate aromatic carbons and improve the jet fuel quality requires severe process conditions such as very high hydrogen partial pressures (greater than 1,500 psi) to obtain high saturation at reasonable reaction temperatures and contact times.

The present invention is concerned with a process of upgrading jet fuel quality by altering the aromatic materials contained within the jet fuel distillate. Aromatic content of the jet fuel is altered by co-processing the jet fuel range distillate with light olefins over large pore zeolites. Upon reaction, much of the aromatic content of the jet fuel range distillate is converted to high molecular weight alkyl aromatics, thus shifting many of the aromatic carbons in the 300° F. to 500° F. fraction into the 550° F.+ range. The alkyl aromatics can then be removed from the olefinic jet fuel by distillation.

2. Description of the Prior Art

The production of alkyl aromatic compounds by reacting aromatic and olefinic hydrocarbons is well known. For example, U.S. Pat. No. 2,904,607 relates to a process for the production of alkyl aromatic hydrocarbon compounds of high anti-knock value, which are of suitable boiling range for use as motor fuels. This patent discloses that aromatic hydrocarbons may be particularly readily alkylated with olefins by contacting the reagents at moderately elevated temperatures with a crystalline aluminosilicate catalyst having pore openings adequate to admit freely the individual aromatic and olefinic molecules, the pore openings being about 6 to 15 Angstroms.

U.S. Pat. No. 3,251,897 also relates to the alkylation of aromatic hydrocarbons in the presence of an aluminosilicate catalyst. The alkylating agents may be employed in fluid media which contain major proportions of inert diluents.

U.S. Pat. Nos. 4,301,316 and 4,301,317 disclose processes for the selective alkylation of aromatic compounds with a relatively long chain length alkylating agent to produce linear phenylalkanes enriched in the 2-phenylalkane isomer. The process utilizes a selective zeolite catalyst characterized by a crystal structure having channels or network of pores therethrough, the major dimension of the openings to said channels or networks of pores being about 6 and about 7 Angstroms.

U.S. Pat. No. 3,663,428 relates to the co-processing of lower olefins and a tar fraction consisting essentially of polycyclic aromatic compounds to obtain a product comprising a mixture of compounds having alkyl side chains. The tar fraction which is employed is obtained from the heavy cracking oil produced by thermally cracking petroleum hydrocarbons at a temperature above 700° C. and below 2300° C., and subsequently removing solid pitch from the heavy cracked oil, and which consists of a fraction boiling at 200° C. to about 500° C., calculated at normal pressure. The alkylation reaction is conducted by mixing the gaseous olefin with the tar fraction and passing the mixture over a solid catalyst bed. The catalyst to be used includes silica-alumina catalysts among others. The alkylated tar produced by the process of the patent is used as an electric insulating oil, a rubber processing oil, a heat transfer oil, a plasticizer, etc.

U.S. Pat. No. 3,894,939 discloses co-processing a gasoline boiling range fraction which contains about at least 20 weight percent aromatics and a gas oil fraction having an end point up to about 850° F. and a pour point of at least about +20° F. over a zeolite catalyst to form a product comprising a gas oil fraction having a lower pour point, a gasoline fraction having a higher octane and a light gas fraction.

SUMMARY OF THE INVENTION

In accordance with the present invention, light olefins ($C_3$–$C_7$) are co-processed with a light distillate (300°–700° F.) over a large pore zeolite.

It has now been found that jet fuel quality can be improved by co-processing light olefins with a jet fuel range distillate over a large pore zeolite to produce a jet fuel range olefinic distillate and high molecular weight alkyl aromatics. The aromatic carbons in the 300° F. to 550° F. fraction of the jet fuel range distillate before processing are, following alkylation with the olefins, shifted into the 550° F.+ range and are thereby removable from the jet fuel fraction by distillation. The 550° F.+ alkylated aromatic product consisting mostly of aromatics with $C_3$–$C_7$ alkyl side chains are of an improved cetane value and can be used as blending material for diesel fuel. A further advantage resulting from the co-processing of a jet fuel range distillate and light olefins is that the distillate acts as a heat sink for the alkylation of the aromatics with the olefins and for olefin to olefin reaction, thus reducing the need for costly gas or liquid recycle.

Accordingly, it is an object of the present invention to provide a process for removing aromatics from jet fuel range distillates.

Another object of the present invention is to provide a process for increasing aromatic compound cetane number.

Another object of the present invention is to produce a jet fuel boiling range olefinic distillate.

It is still further an object of this invention to react a jet fuel range distillate with light olefins over a large pore zeolite so as to alkylate the aromatics contained in the jet fuel and thus form an olefinic jet fuel distillate and a high molecular weight alkylated aromatic fraction which can be removed from the jet fuel distillate and which has a higher cetane value than the aromatic fraction before the reaction.

Other and further objects and advantages of the present invention will become more clear hereinafter.

BRIEF DESCRIPTION OF THE DRAWINGS

FIG. 1 is a schematic illustration of one possible configuration for co-processing jet fuel and light olefins.

DETAILED DESCRIPTION OF THE INVENTION

Exemplary of the catalysts which are useful for the co-processing of light olefins with a jet fuel range distillate include crystalline aluminosilicate catalysts having pore openings adequate to admit freely the individual aromatic and olefinic molecule. The pore openings will therefore be about 6 to about 15 Angstroms and, preferably, the crystalline aluminosilicate catalysts can be characterized as large pore zeolites, i.e., those materials having a pore size of at least 8 Angstrom units. Examples of such preferred zeolites include ZSM-4 which is described in U.S. Pat. No. 3,923,639 and ZSM-12 which is described in U.S. Pat. No. 3,832,449. Typically, the preferred zeolites will have a relatively high silica-to-alumina ratio in the framework of the zeolite, preferably at least 12. The characteristics of zeolites useful in the present invention are adequately described in the above-mentioned patents as well as a method for making same. These patents are incorporated herein by reference.

As has been stated above, the present invention presents an alternative to the previous methods of upgrading jet fuel or other light distillates which contain a sufficiently high aromatic content that degrades the fuel quality. As an alternative to solvent extraction of the aromatics or the use of severe hydrotreating, the present invention co-processes, i.e., reacts, a jet fuel range distillate having a boiling range of at least about 325° F. to 700° F. and which contains at least about 20% by weight aromatics with a light olefin ($C_3$–$C_7$) stream over a large pore zeolite as described above. The co-processing of the light olefin charge with the light distillate yields an improved product slate including a jet fuel range olefinic distillate and contained therein a high molecular weight alkyl aromatic fraction. The alkyl aromatics are formed from the reaction of the light olefins with the aromatics in the light distillate. The aromatic content having a boiling range of 300° F. to 550° F. in the jet fuel distillate is, following alkylation, shifted into the 550° F.+ range and may be removed from the jet fuel range olefinic distillate by distillation. The 550° F.+ product, consists mostly of aromatics with $C_3$–$C_7$ alkyl side chains. This higher boiling fraction is of improved cetane value and thus can be used as blending material for diesel fuel. Table I illustrates the cetane number for various alkyl aromatics.

TABLE I

| Alkyl Aromatic Cetane Numbers* | Cetane Number |
|---|---|
| n-Pentyl Benzene (n-$C_5^-$) | 18 |
| n-Hexyl Benzene (n-$C_6^-$) | 32 |
| n-Heptal Benzene (n-$C_7^-$) | 39 |
| n-Nonol Benzene (n-$C_9$) | 51 |
| n-Dodecal Benzene (n-$C_{12}^-$) | 68 |
| n-Tetradecal Benzene (n-$C_{14}^-$) | 72 |
| α-Methyl-naphthalene ($C_1^-$) | 0 |

TABLE I-continued

| Alkyl Aromatic Cetane Numbers* | Cetane Number |
|---|---|
| n-Butyl-naphthalene (n-$C_4^-$) | 8 |
| n-Octol-naphthalene (n-$C_8^-$) | 20 |

*Data from "Diesel Fuel Oils", 19th ASME National Oil and Gas Power Conference, May 20, 1947, pages 86 & 87.

The jet fuel range product which is produced is an olefinic distillate substantially devoid of the undesirable aromatic content of the jet fuel range distillate before co-processing. An important advantage which is presented in co-processing light olefins with the jet fuel range distillate is provided by the distillate which acts as a useful heat sink for the reaction and thus reduces or eliminates the need for costly gas or liquid recycle.

The process of the present invention comprises co-processing a jet fuel range distillate having a boiling range of about 300° F. to 550° F. and containing at least about 20% by weight aromatics with a light olefin ($C_3$–$C_7$) over a relatively large pore zeolite as discussed above at a temperature of about 350° F. to about 700° F. and a pressure of about 10 to about 100 atmospheres. Optionally, the product can be subjected to hydrotreating at a hydrogen to hydrocarbon ratio of about 2 to about 10. The product thus formed comprises an olefinic distillate having a boiling range about 325° F. to less than 550° F. and a 550° F.+ distillate consisting essentially of aromatics with $C_3$–$C_7$ alkyl side chains.

Table II illustrates the properties of a jet fuel made from pure olefins. The properties of the olefinic jet fuel formed by the present invention are the same as the jet fuel formed from pure olefins. Properties of commercial Jet A fuel are provided for comparison.

TABLE II

| Jet Fuel Properties | | |
|---|---|---|
| Fuel | Olefin | Jet A |
| Gravity, °API | 51.4 | 37-51 |
| Freeze Point, °C. | <−60 | −40 |
| Luminometer Number | 101 | 45 |
| Smoke Point, MM | 28 | 18 |
| Aromatics, Vol % | 3.6 | 25 |
| Sulfur, Wt % | 0 | 0.3 |
| Hydrogen Content, Wt % | 15.2 | — |
| JFTOT Breakpoint, °F. (Oxidative Stability Test) | 640 | 540 |

The catalyst can be used in a fixed, moving or fluidized bed as desired with the reaction zone appropriately designed therefor. The reaction zone may be operated in an upflow or downflow, co-current or countercurrent manner utilizing either trickle or flooded operation. The catalyst can be used as such or can be employed in a matrix as per for the referred to patents. When used in a matrix such as alumina or silica or the like, the proportion of active zeolite material is preferably at least about 25% by weight.

Referring now to FIG. 1 which illustrates in schematic form one possible system which may be employed to co-process the jet fuel distillate and light olefin streams, the light olefin and jet fuel distillate streams are mixed in a weight ratio of about 0.2 to about 1.0 part olefin to 1.0 part jet fuel distillate. The mixture is heated in heat exchangers 1 and 2 with reactor effluent to conserve the heat of reaction. In furnace 3, the mixed feed stream is heated to the proper reaction temperature of about 450° F. The heated mixed feed stream enters the top of reactor 4 which contains the relatively large pore catalyst such as the preferred materials of ZSM-4 or ZSM-12. The co-processed stream leaves the bottom of reactor 4 as mentioned previously and heats the incoming mixed feed in heat exchanger 2 and is then directed to high temperature separator 5. A 330° F.+ stream leaves the bottom of separator 5 and is sent directly to distillation column 8 for division into the 330° F. to 550° F. olefin distillate product and the bottoms 550° F.+ alkyl aromatic fraction. Optionally, the co-processed product can be directed from separator 5 to hydrotreater 9 for the purpose of saturating the jet fuel range olefins. The hydrotreated co-processed stream can then be separated in distillation column 8 as previously mentioned. The light gas stream formed in reactor 4 and leaving high temperature separator 5 is directed to a low temperature separator 6 operating at a temperature of about 100° F. to about 250° F. for separating the light gasoline stream into a light gas and a substantially olefin bottom product which can be recycled to the light olefin feed stream via a liquid recycle pump 7.

This invention will be illustrated by the following example which is not to be considered as limiting the scope of the present invention. Parts and percentages are by weight unless expressly stated to be to the contrary.

EXAMPLE 1

A mixture comprising 25 weight percent n-Hexene and 75 percent jet fuel were co-processed over ZSM-12 and ZSM-4 catalysts. Table III shows the properties of the charge as well as the co-processed product formed in the presence of each of the respective catalysts.

From Table III, the results show a net yield of 330° F.+ material from reacting the light olefin stream with the jet fuel distillate. There is an increase in measured total aromatic, essentially all of which is in the 550° F.+ range indicating alkylation of the existing aromatic rings, thus increasing their boiling point. As indicated earlier and seen from Table I, there is an increase in cetane number resulting from the addition of side chains to aromatic rings.

TABLE III

| | CHG | ZSM-12 | ZSM-4 |
|---|---|---|---|
| Catalyst | | | |
| °F. | | 450/500 | 450/500 |
| PSIG | | 500 | 500 |
| LHSV | | 0.5 | 0.5 |
| IBP - 300° F. | | | |
| Wt % | 28 | 13.3 | 17.7 |
| °API | 75.2 | 66.3 | 71.0 |
| BR # | — | 76.2 | — |
| 300° F.-550° F. | | | |
| Wt % | 72 | 77.6 | 74.0 |
| °API | 47.2 | 46.9 | 47.2 |
| Br # | — | 11.7 | 6.9 |

TABLE III-continued

| | CHG | ZSM-12 | ZSM-4 |
|---|---|---|---|
| Aniline Pt | 142.5 | 143.1 | 142.2 |
| Yield on 330° F.+ % | 100.0 | 107.6 | 103.0 |
| Dist. °F. | | | |
| 10%/50%/90% | 355/397/500 | 333/406/509 | 327/404/515 |
| FIA, Vol % | | | |
| Aromatic | 20.1 | 20.5 | 21.0 |
| Olefins | 2.2 | 12.4 | 6.0 |
| Saturates | 77.7 | 67.1 | 73.0 |
| 550° F.+ | | | |
| Wt % | 0 | 9.2 | 8.4 |
| °API | | 32.0 | 29.4 |
| Br # | | 13.1 | 5.3 |
| Aniline Pt | | 155.2 | 156.7 |
| Dist. °F. | | | |
| 10%/50%/90% | | 561/629/735 | 562/630/786 |
| FIA, Vol % | | | |
| Aromatic | | 95.9 | |
| Olefins | | 3.2 | |
| Saturates | | 0.9 | |
| % 330° F.+ | 72 | 86.7 | 82.3 |
| % Ar in 330° F.+ | 20.1 | 24.7 | 23.6 (est) |

What is claimed is:

1. A process for upgrading a petroleum fraction having a boiling range of about 300° F. to about 550° F. and which contains at least about 20% by weight aromatics, comprising contacting said petroleum fraction with an olefin stream in the presence of a zeolite catalyst having a pore size of about 6 to about 15 Angstroms and recovering a product stream comprising an olefinic distillate having a boiling range of about 300° F. to less than 550° F. and an alkyl aromatic fraction having a boiling range greater than 550° F.

2. The process for claim 1 wherein said zeolite catalyst is ZSM-4 or ZSM-12.

3. The process for claim 1 wherein said olefin stream comprises $C_3$–$C_7$ olefins.

4. The process for claim 1 wherein said product is resolved into said olefinic distillate and said alkyl aromatic fraction by distillation of said product stream.

5. The process for claim 4 wherein said alkyl aromatic fraction comprises aromatic compounds having $C_3$–$C_7$ alkyl side chains.

6. The process for claim 1 wherein said product stream is hydrotreated.

7. The process for claim 1 wherein said petroleum fraction is a jet fuel range distillate having a boiling range of about 350° 1 F. to 550° F.

8. The process for claim 1 wherein the weight ratio of said olefin stream to said petroleum fraction is about 0.2 to about 1.0.

9. The process for claim 1 wherein the reaction temperature is about 350° F. to about 700° F.

10. The process for claim 1 wherein said petroleum fraction and said olefin stream are mixed prior to contact with said catalyst.

* * * * *